US006324776B1

(12) United States Patent
Miyata

(10) Patent No.: US 6,324,776 B1
(45) Date of Patent: Dec. 4, 2001

(54) METHOD OF SMOOTHING CLOTHS TO BE FINISHED AND ITS DEVICE

(76) Inventor: Yukio Miyata, 738-6, Odera, Mihara-cho, Minamikawachi-gun, Osaka (JP)

( * ) Notice: Subject to any disclaimer, the term of this patent is extended or adjusted under 35 U.S.C. 154(b) by 0 days.

(21) Appl. No.: 09/800,948

(22) Filed: Mar. 7, 2001

(30) Foreign Application Priority Data

Dec. 27, 2000 (JP) ..... 12-398121

(51) Int. Cl.[7] ..... D06F 71/00; D06F 71/40
(52) U.S. Cl. ..... 38/12
(58) Field of Search ..... 38/12, 13, 21, 38/20, 14, 64

(56) References Cited

U.S. PATENT DOCUMENTS 1,857,657 * 5/1932 Pauly ..... 38/12
2,522,168 * 9/1950 Epstein ..... 38/12
5,692,326 * 12/1997 Mohan et al. ..... 38/12
5,758,437 * 6/1998 Tamamoto ..... 38/12

* cited by examiner

*Primary Examiner*—Ismael Izaguirre
(74) *Attorney, Agent, or Firm*—Moonray Kojima

(57) ABSTRACT

The present invention relates to the method of obtaining a fine finishing condition of the cloth, for instance, pressing the cloths like collars and sleeves of the washed shirts and its device, wherein the upper smoothing iron is brought down against the cloth on the lower smoothing iron in order to press the cloth and during this step and in its previous step, vapor is sprayed to the cloth, extending it by a extending machine, while heat-pressing the cloth after it has recovered its original form.

8 Claims, 13 Drawing Sheets

METHOD OF SMOOTHING CLOTHS TO BE FINISHED AND ITS DEVICE

BACKGROUND OF THE INVENTION

1. Field of the Invention

The present invention relates to an art of finishing cloths like collars or sleeves of shirts, which have been washed.

2. Description of the Prior Art

Collars or sleeves of the shirts are so constructed that a thin attaching core of the cloth is inserted between two cloths both sides of face and reverse and they have been high-pressed. The above attaching core of the cloth shrink by 10 to 15% after being washed. Therefore, the surface of cloths has many waves of shrinkage, thus making the size small. According to the conventional device, the size is small and easy to shrink as the cloths are high-heat pressed at once because of the preference for the operational efficiency, wherein the cloths are to be made out as they are shrunk without getting rid of shrinkage as indicated above.

SUMMARY OF THE INVENTION

The main purpose of the present invention is to be able to smooth the shrinking core of cloths even when using the machine to smooth it.

In other words, it is designed to provide a method of smoothing cloths, wherein the upper smoothing iron is brought down against the cloth on the lower smoothing iron, thus pressing the said cloth, taking a step of smoothing the cloth applying thereto the power during the pressing step and in also the previous step, giving vapor to the above said cloth in the above said step of smoothing or in the previous step.

It is also designed to provide a device for smoothing cloths, wherein the cloths are put between the upper smoothing iron and the lower smoothing iron to be pressed, providing a extending system to pull the edge of the cloths before the said step of pressing, which system is put in the vicinity of the lower smoothing iron to put the above said cloths on, while providing a vapor supplying system to spray vapor to the said cloths, which system is put in the vicinity of the lower smoothing iron or just on it.

Here, the above mentioned step of pressing means to press strongly with much pressure and the pressing step takes a time from the moving upper smoothing iron touching strongly the cloth until it is detached from there. In other words, while the upper smoothing iron is moving as it should be, it is not the time of pressing until the upper smoothing iron touches the cloth strongly and it should rather be considered a previous step before pressing.

In other words, according to the above said construction, the cloth on the lower smoothing iron is to be extended by effects of the extending process or an extending system during the pressing step or the previous step. The cloth will be immediately heated and given water so that the cloth will be easily extendible after vapor is sprayed to the cloth during the extension or in the previous step. Thus, even in the smoothing step by a machine to elevate the operational efficiency, the cloth can be pressed as it is extended, thus allowing for the good finishing condition like new goods without shrinkage or wrinkles.

The above mentioned cloth includes the collars, the sleeves and the front part of the shirts having the attaching core of cloths as specified above together with the cloth of other cotton products.

Another purpose of the present invention is to obtain a fine finishing condition of the cloths by touching the cloths from above and regulating the move of the cloths during the extending process.

Therefore, when the regulating device is set to regulate the move of the cloth during the extending step, a fine condition of the cloth can be obtained as it is possible to stop the move the cloth, even in the case the cloth is about to turn aside because of the timing difference or hook as the extending step finishes.

So far, when washing, the temperature of water used to have to be regulated strictly for fear that the cloth might get shrunk. It is because the cloth will shrink very much when the temperature of water is high, even though dirtiness can be removed.

This means that it used to be difficult to contain shrinkage while getting rid of the dirtiness. However, with this invention, all it concerns is to look at the side of removing the dirtiness rather than shrinkage, so that there is no need for the skill of the experts, allowing for rapid and easy washing, which is satisfactory.

Another purpose of the present invention is to provide a fine smoothing of the collars or sleeves of the shirts to finish, which is liable to shrink.

In other words, when there are smoothing irons (an upper iron and a lower iron) to pinch the collars of the shirt and smoothing irons (an upper iron and a lower iron) to pinch the sleeves of the shirt or when having both of them, shrinkage of the collars and sleeves of the shirts can be resolved as they have been trying to do so for a long time. When two types of the smoothing irons are provided so that the collars and sleeves will be smoothed and finished, the operational efficiency will improve.

Another purpose of the present invention will be clarified according to the examples set forth below.

EXAMPLES

One preferred embodiment of the present invention will be particularly described below using the related figures.

Figure 1:
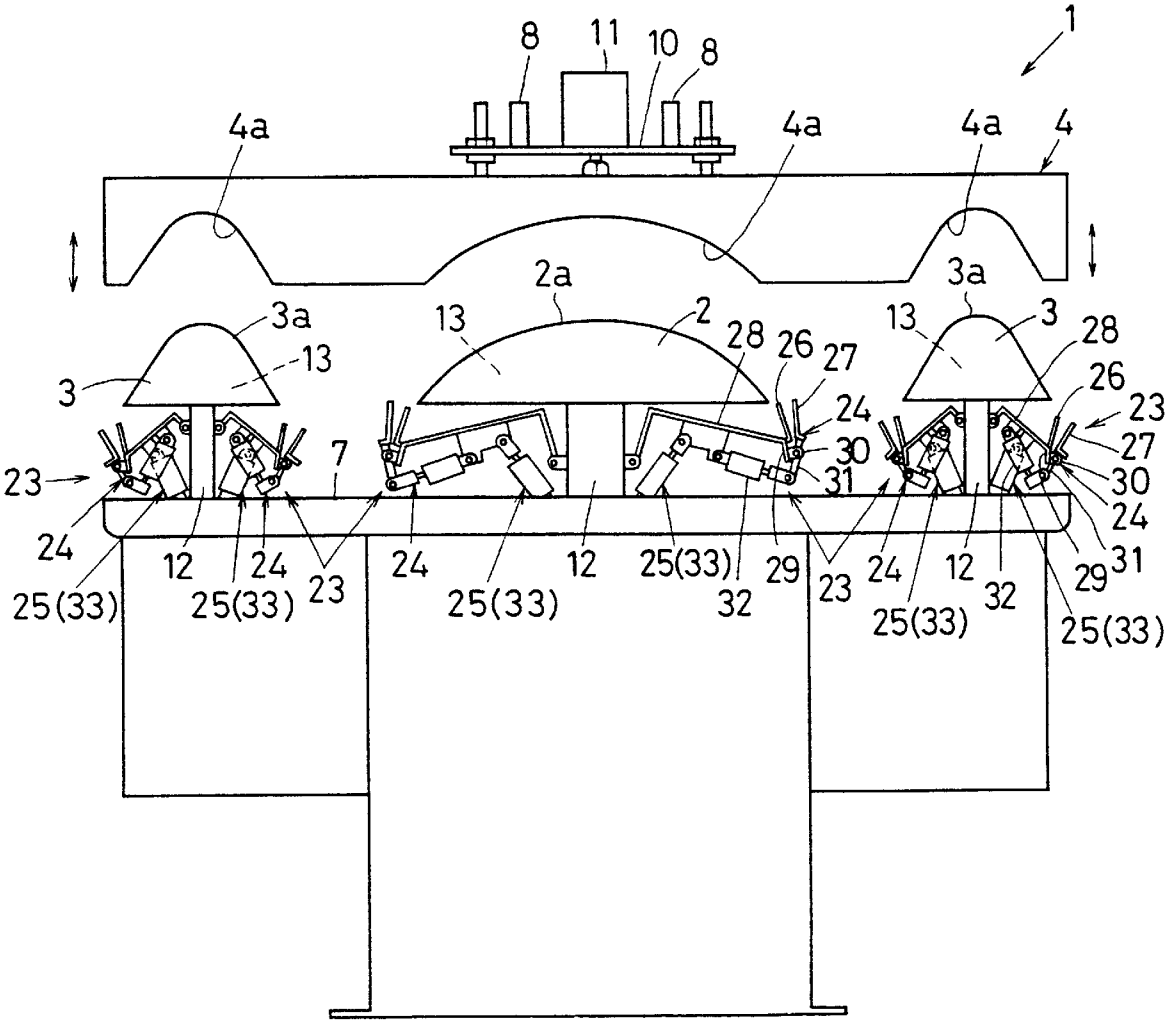
FIG. 1 is a front view of the device for smoothing the cloth to finish according to the present invention.

The device 1 (to be called the device in the following sentences,) a heat-pressing device, which lowers the upper smoothing iron 4 against the lower smoothing irons 2, 3, 3 and heat-presses the collar 5 and sleeve 6 (the cloth) of the shirt. According to the FIG. 1, the above mentioned lower smoothing irons 2, 3, 3 are facing the upper smoothing iron 4.

The device 1 is provided with one lower smoothing iron 2 for collars with a mild curve on its upper surface and two lower smoothing irons 3, 3 for sleeves with a roughly triangle form seen from front so that the collar 5 and sleeve 6 can be heat-pressed at the same time, thus forming three pressing surfaces 4*a* and so on, on the upper smoothing iron 4, corresponding to the pressing surfaces 2*a*, 3*a* of the lower smoothing irons 2, 3, 3.

Figure 2:
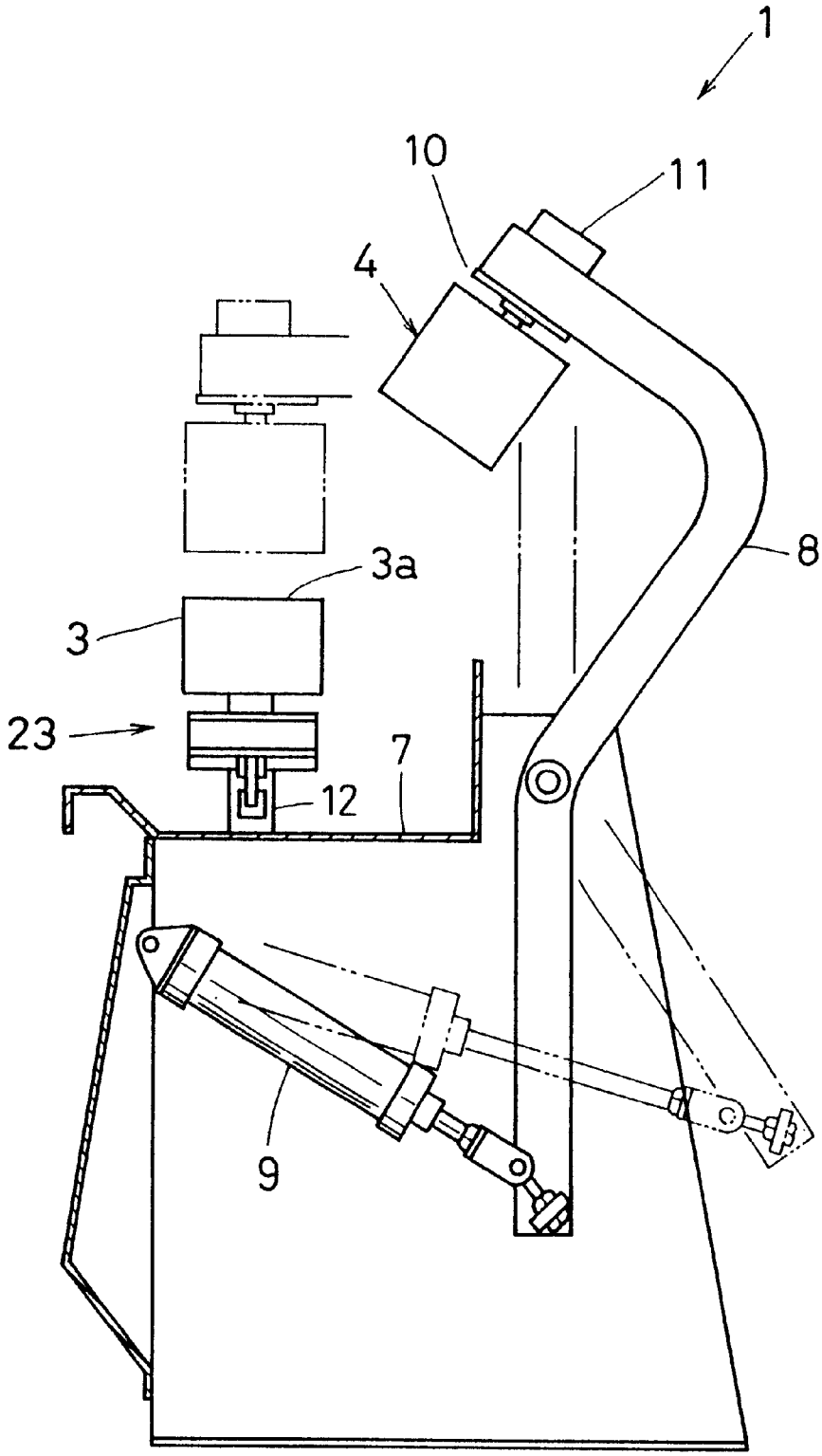
FIG. 2 is a partial sectional side view of the device in the FIG. 1.

The upper smoothing iron 4 contains the heating device (not shown in the figures) as widely known and is provided with the heating plate (not shown in the figures), on the pressing surfaces 4*a* and so on. In addition, the upper smoothing iron 4 fixed on the point part of the two rocking arms 8, 8, right and left, encased on the reverse side of the base 7, thus the upper smoothing iron 4 rocking from the inclining position backwards indicated with the solid line in the FIG. 2 to the position facing the lower smoothing irons 2, 3, 3, as shown with a virtual line. This rocking is done by the air-cylinder 9 for rocking, connected to the below end of the rocking arms 8, 8. The above mentioned two rocking arms 8, 8 and the upper smoothing iron 4 is fixed by the connecting plate 10 connecting between the rocking arms 8, 8 and through the air-cylinder 11 moving up and down, which air-cylinder is placed on the said connecting plate 10.

The above said lower smoothing irons 2, 3, 3 are supported at a determined height by the support 12 above the base 7. Also, they are provided with the vapor-supplying device 13 so that heat and water will be given to the cloth to put thereon.

Figure 3:
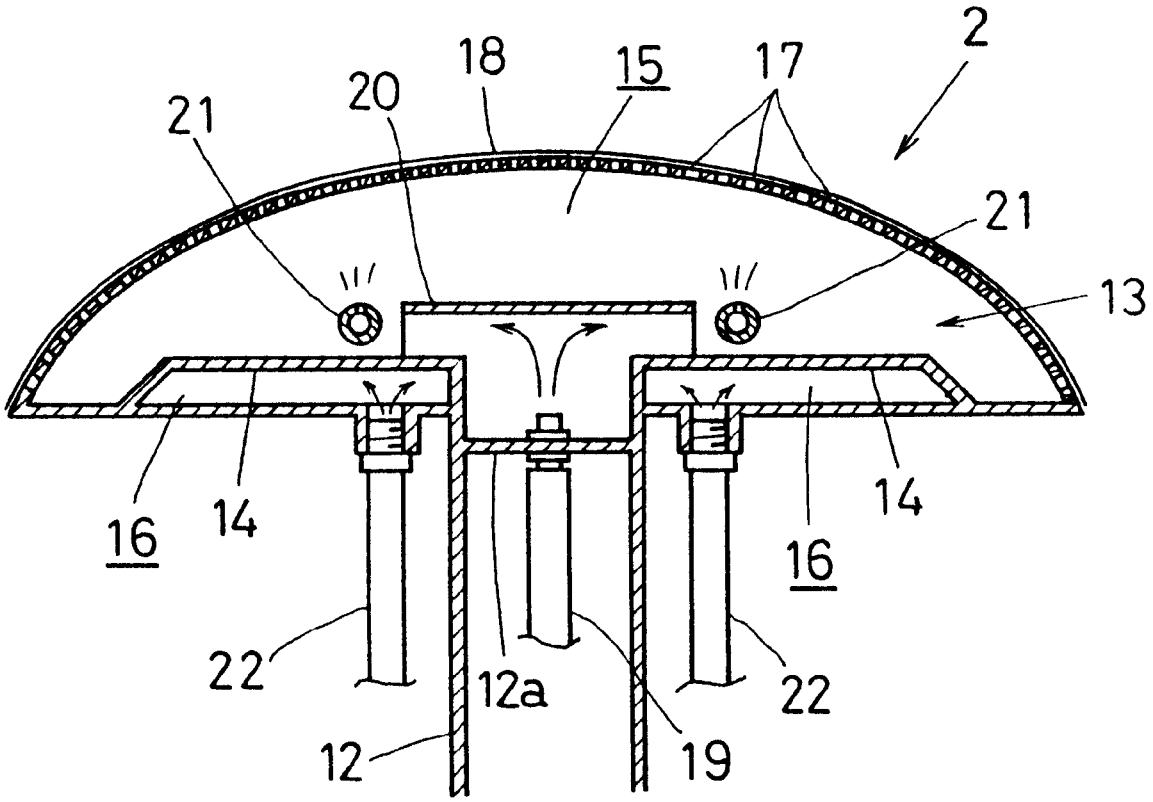
FIG. 3 is a section view of the inner structure of the lower smoothing iron.
Figure 4:
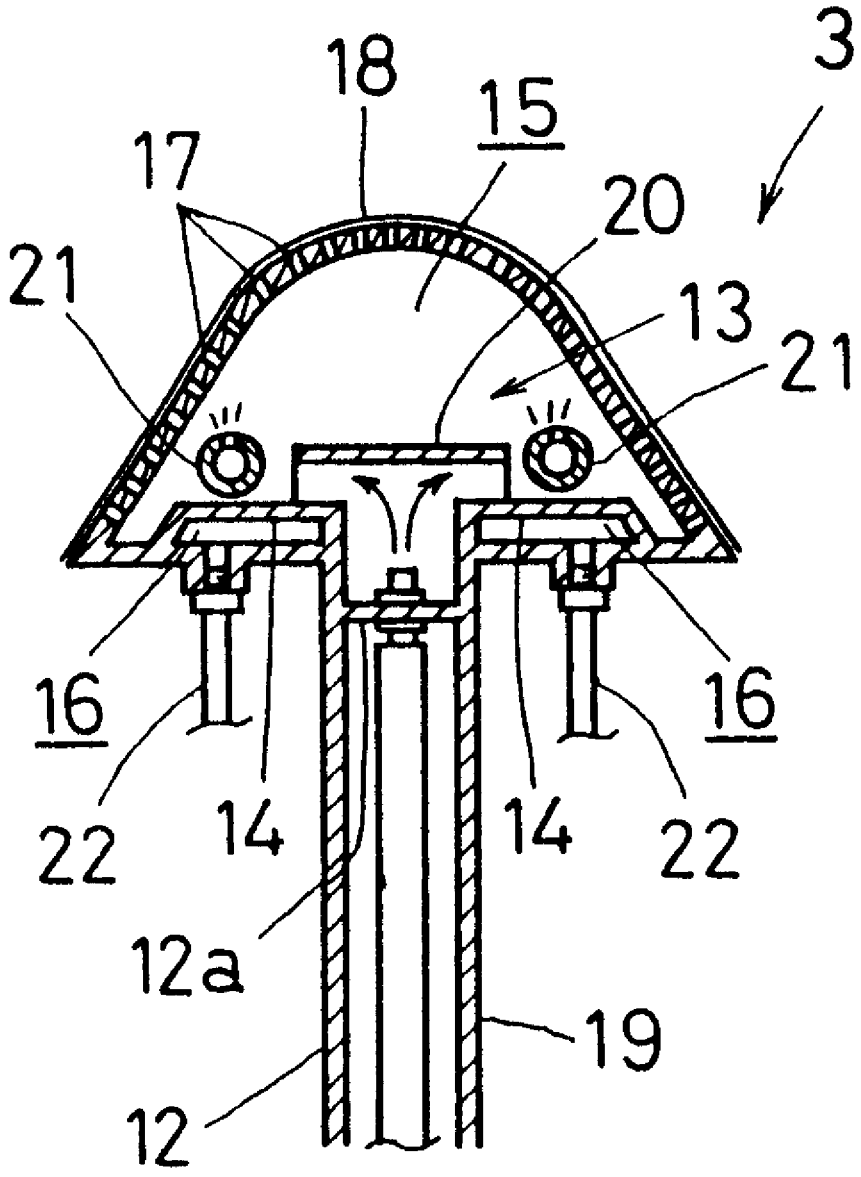
FIG. 4 is a section view of the inner structure of the lower smoothing iron.

The FIG. 3 shows the inner structure of the lower smoothing iron 2 for the collars, while the FIG. 4 shows the inner structure of the lower smoothing irons 3, 3 for sleeves. According to those section views, the inner part is divided between two layers, the upper and the lower (the space 15 on the upper side and the space 16 on the lower side) by the separating wall 14. On the upper surface, there are many round holes 17 and so on, which have small diameter, on which the covering material 18 with airing is attached.

The above mentioned support 12 is a vacant cylinder containing the air-supplying tube 19 connected to the air-supplying blower (not shown in the figures), provided inside the device 1, wherein the point part is fixed onto the separating wall 12*a* on the upper side inside the support 12, thus connecting to the space part 15 above the said upper side. In front of the spraying side of the above said air-supplying tube 19 there is provided a little bit away the diffusing plate 20 for diffusing the air inside the upper space part 15. Also, inside the upper space part 15 there is installed the vapor tube 21 connected to the vapor generating device (not shown in the figures) through the vapor-supplying part (not shown in the figures).

The vapor-supplying tube 22 is connected to the above said vapor-supplying part, communicating with the space part 16 of the lower side of the space parts including two layers, the upper and the lower, so that the lower smoothing irons 2, 3, 3 are heated by vapor to keep the determined temperature.

Figure 5:
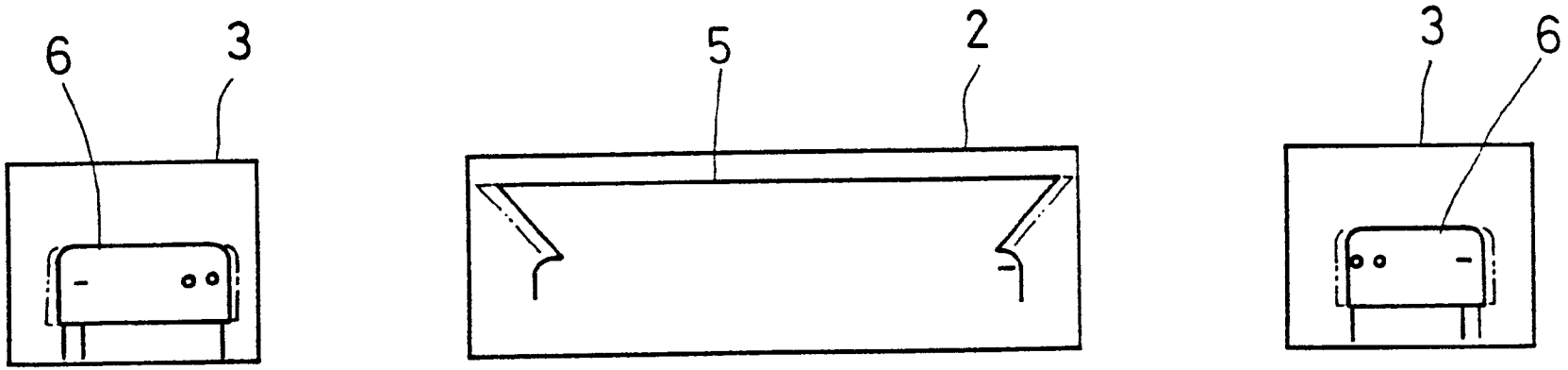
FIG. 5 is a plan view of the lower smoothing iron in the FIG. 1 and the cloth on it.

In the vicinity of the lower smoothing iron, there is provided the extending machine 23 for extending the cloth (the collar 5 and the sleeve 6) put on the lower smoothing irons 2, 3, 3, as they are shown in the FIG. 5 with a virtual line.

This extending machine 23 is installed on the both end sides of each of the lower smoothing irons 2, 3, 3, provided with the pinching device 24 for pinching the edge of the cloth and the driving device 25 for moving the above mentioned pinching device 24 toward the lower direction the cloth is extending.

The pinching device 24 has the receiving piece 26 in the shape of the quadrangle plate and the pressing piece 27 attaching and detaching from the said receiving piece 26. The receiving piece 26 is fixed on the tip of the rocking material 28, which rocks up and down, being encased on the side of the above said support 12. The rocking material 28 is so constructed as to reach along beneath of the lower smoothing irons 2, 3, 3 when moving upwards, wherein the receiving piece 26 stays a bit away from the upper side of the lower smoothing irons 2, 3, 3, fixing the receiving piece 26, making an acute angle toward the rocking material 28.

Below the receiving piece 26 on the tip of the rocking material 28, there is formed the supporting piece 29 on which piece 29 there is provided the encasing supporting piece 30, thus encasing the pressing rod 31 in a rotating way, which rod is extended from the base end of the above said pressing piece 27. The pressing rod 31 is to be rotated through the pinching air-cylinder connected to the rear end of the pressing rod 31. The base part of this pinching air-cylinder 32 is encased in the below part of the above mentioned rocking material 28.

In addition, the above said driving machine 25 rocking the said rocking material 28 up and down is to be encased on its tip in the below side of the rocking material 28, thus composed of the pulling air-cylinder 33 which is encased in the below part of the support 12 on its base part. This pulling air-cylinder 33 is rocked in such a way that the pinching device 24 is to be placed below the down position of the upper smoothing iron 4 when the upper smoothing iron 4 is brought down and the above said air-cylinder is brought down, thus avoiding contact with the upper smoothing iron 4.

With the device 1 thus constructed, the smoothing of the collar 5 and the sleeve 6 of the shirt will be finished as follows.

First, the pressing piece 27 of the pinching device 24 is kept away from the receiving piece 26 and the pinching device 24 is to be placed on the upper side of both sides, right and left, of each of the lower smoothing irons 2, 3, 3. Furthermore, the cloth is extended over each of the lower smoothing irons 2, 3, 3, so that both edges of the cloth are to be pinched by the pressing piece 27 of the pinching device 24, being inclined.

Here, the upper smoothing iron 4 is made facing the lower smoothing irons 2, 3, 3 in order to drive the vapor supplying device 13. By driving the vapor-supplying device 13, vapor is spraying from the lower smoothing irons 2, 3, 3, thus touching the cloth.

The cloth is fixed by the pinching device 24 without having to move suddenly and can be kept in such an original condition as it is extended. The temperature of vapor may as well be higher than about 150 degrees centigrade and the spraying may last from one second to 5 seconds approximately. The cloth will be heated while containing vapor and become easy to be extended.

Figure 6:
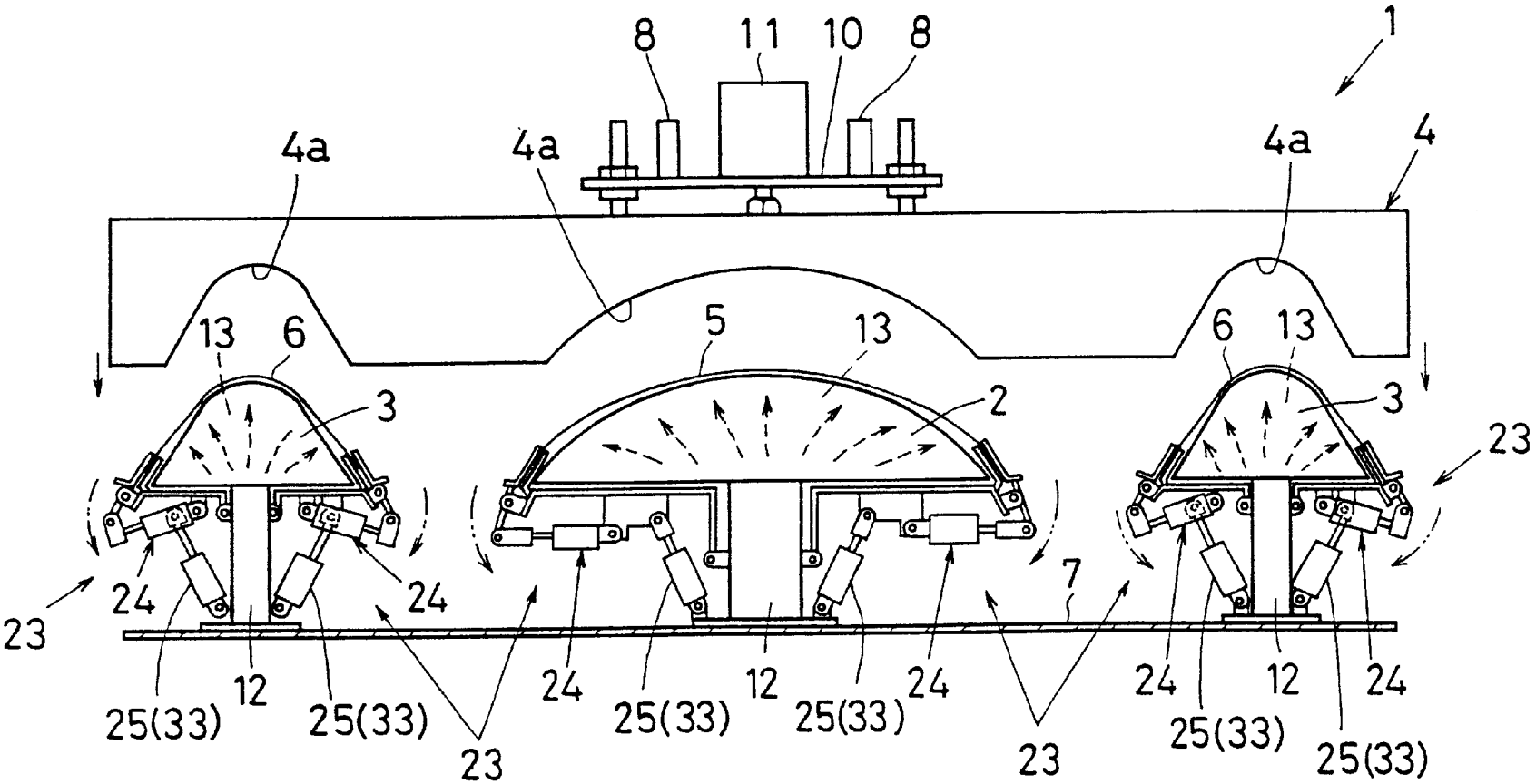
FIG. 6 is a front view of the operation.

The driving machine 25 is to be driven at the same time as the spraying of vapor or a little later than this and by moving the pinching device 24 away, the cloth will be extended (See the FIG. 6). Concretely, vapor may as well be sprayed for five seconds, for instance, thus driving the driving machine 25 at the same time as the spraying of the vapor. After driving the driving machine 25 for a certain period of time, the pinching air-cylinder 32 of the pinching device 24 will be driven in order to release the cloth. When the cloth has been released, the pinching device 24 will retire beneath the lower smoothing irons 2, 3, 3, by the move of the driving machine 25.

Figure 7:
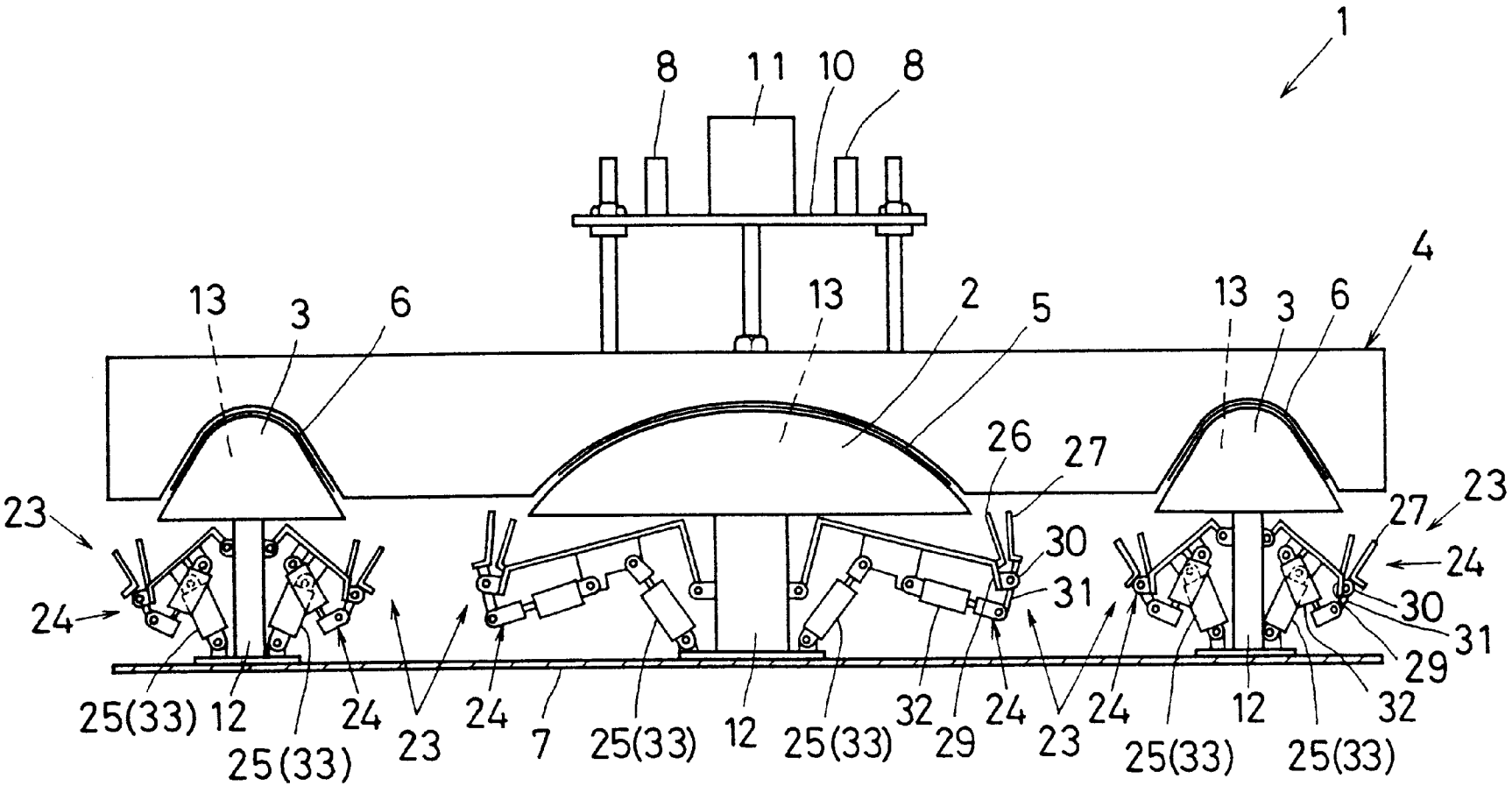
FIG. 7 is a front view of the cloth being heat-pressed

The air-cylinder 11 will now be driven up and down in order to lower the heated upper smoothing iron 4 so that the cloth will be pressed strongly against the lower smoothing irons 2, 3, 3 to finish by pressing (See the FIG. 7). After being pressed for a certain period of time, each part will be in its original place.

In this way, the cloth can be extended in the previous step before pressing to finish, thus allowing for press-smoothing the cloth with the original size, which cloth has been shrunk because of washing. Because of this, the collar 5 and sleeve 6 will not get shrunk as they used to be in a conventional way, thus allowing for a fine finishing condition. In other words, even with the machine smoothing, which is designed to elevate the operational efficiency, the cloth can be pressed as it is extended, thus providing for a fine finishing condition like new goods without shrinkage or wrinkles.

As the cloth will return to the original size by a extending step with the extending machine 23 being used automatically, the operation is easy and the extending process can be done evenly on the cloth, thus providing for an even finishing condition.

In addition, vapor can be sprayed against the cloth, elevating instantaneously to a high temperature and easily extended with a high operational efficiency. Also, as vapor is sprayed, the cloth can easily contain water. Therefore, the cloth can be smoothed and finished with high efficiency upon the cloth starting to get dry some hours after it has been washed.

The vapor supplying device 13 for supplying vapor is contained in the lower smoothing irons 2, 3, 3, so that vapor will be given evenly to the cloth. The operation is easy as there is no need for installing any device for giving vapor separately, thus allowing for clearing the surroundings of the lower smoothing irons 2, 3, 3 and obtaining the safety of the operation.

Furthermore, the rocking device 23 has a structure encasing the base part of the rocking material 28 in the support 12 and making good use of the space around both below sides of the lower smoothing irons 2, 3, 3, with allowance of space between the lower smoothing irons 2, 3, 3, the device 1 becoming compact as a whole, giving good appearances.

So far, when washing, temperature of water used to have to be strictly regulated for fear that the cloth might get shrunk. It is because the cloth will shrink very much when the temperature of water is high, even though dirtiness can be removed.

This means that it used to be difficult to contain shrinkage while getting rid of the dirtiness. However, as the above said finishing step of smoothing the cloth can get rid of shrinkage, all it concerns is to look at the side of removing the dirtiness rather than shrinkage, so that there is no need for the skill of the experts, allowing for rapid and easy washing, which is satisfactory.

There may be provided a smoothing iron for either one of the collar and the sleeves, appropriate for serving for them. When a smoothing iron for other cloths than the collars or sleeves of the shirts is provided, it may serve as a smoothing iron for other cloths to finish.

The FIGS. 8, 9, 10, 11, 12 and 13 show the device as is shown in other examples. This device 1 is provided with the regulating device in order to regulate the move of the cloth immediately before the cloth has been extended as described above so that a fine smoothing condition of the cloth can be obtained. This regulating device is provided in the vicinity of the upper smoothing iron 4 and the lower smoothing irons 2, 3, and 3.

Figure 8:
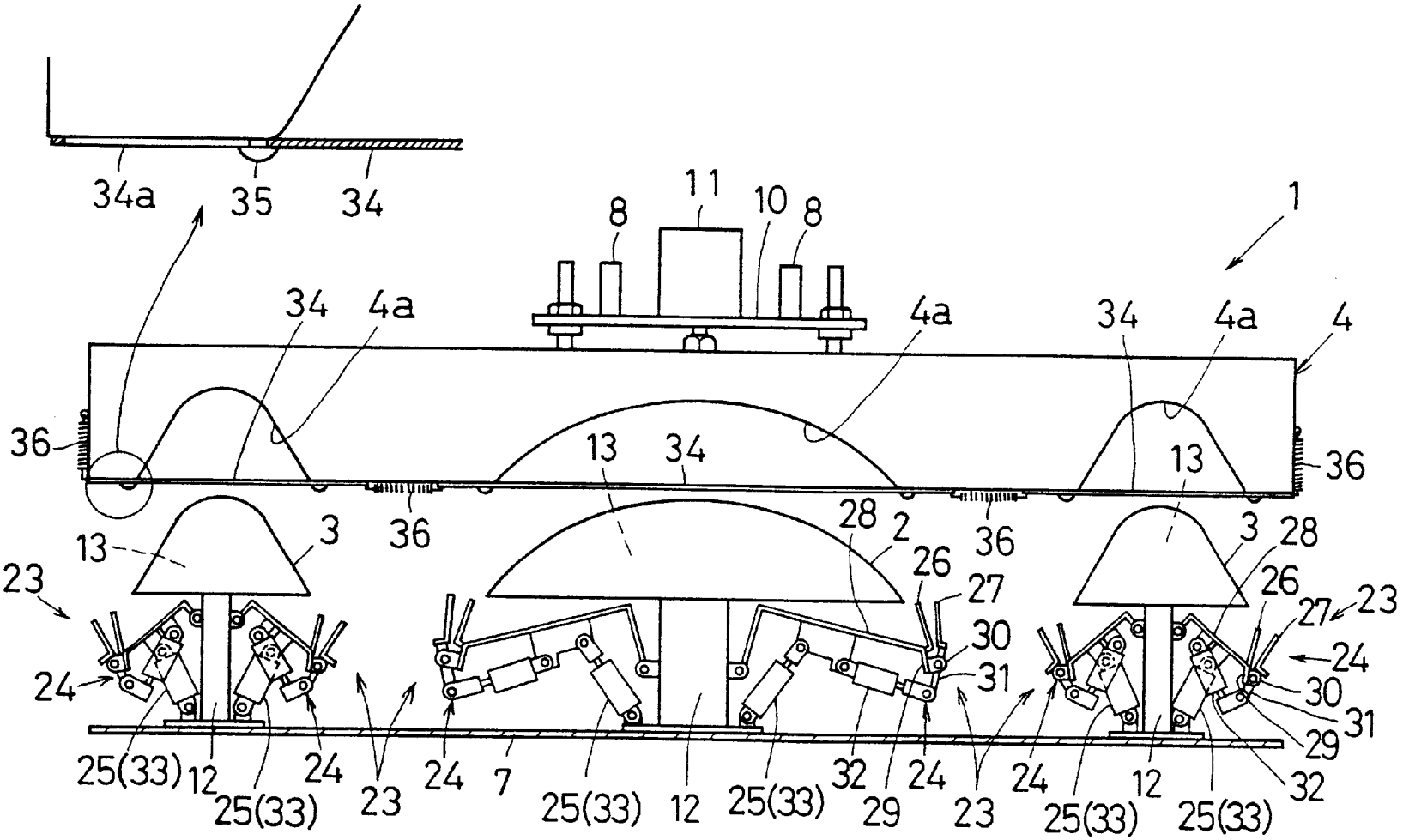
FIG. 8 is a front view of the device for smoothing the cloth to finish according to other examples
Figure 9:
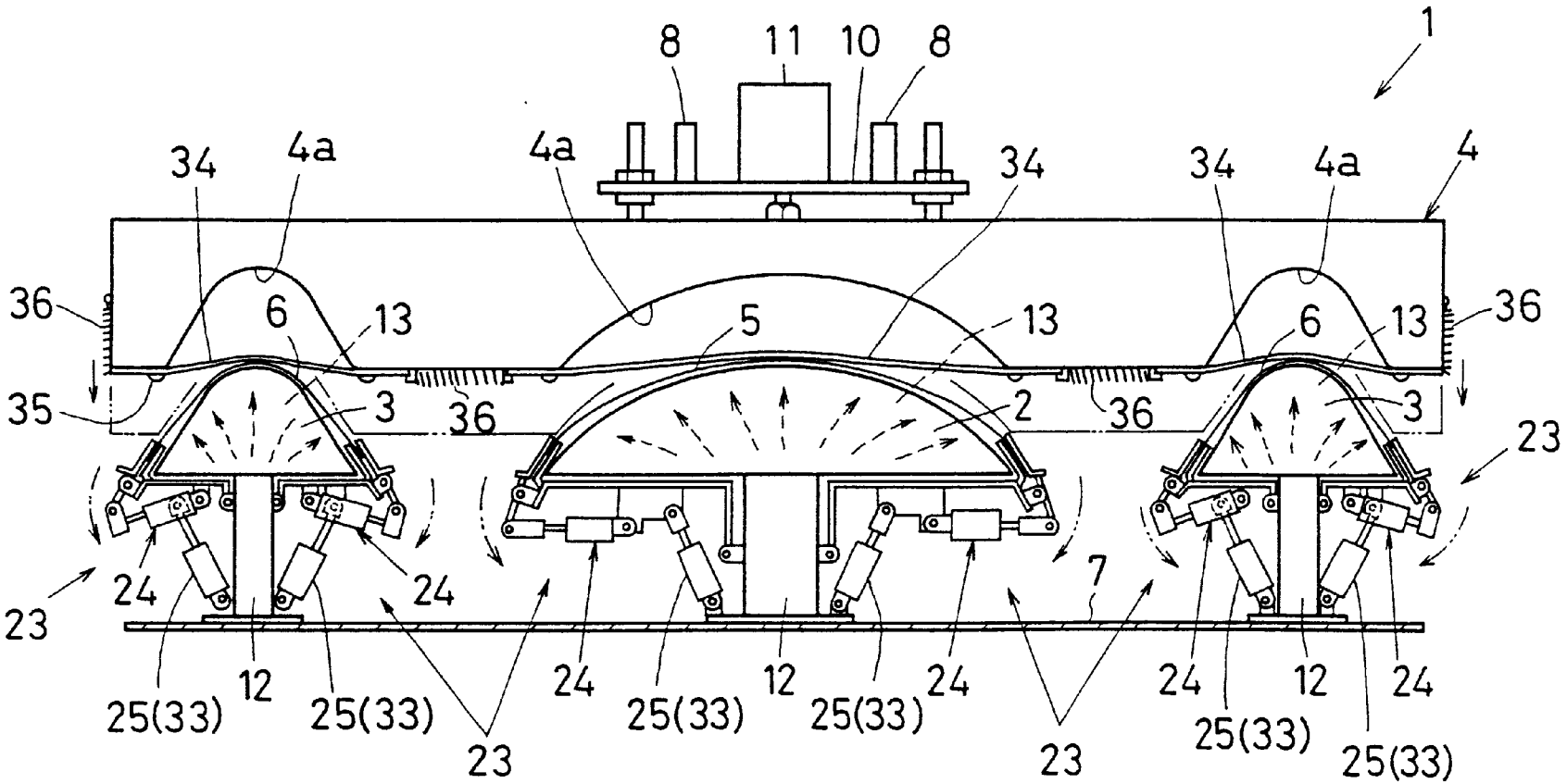
FIG. 9 is a front view of the operation of the device in the FIG. 8.

The device 8 as shown in the FIG. 8 is provided with the sheet body 34 serving as a regulating device so that the pressing surface 4*a* is closed below the upper smoothing iron 4. Other structures including the lower smoothing irons 2, 3, 3 are as described above, which lower smoothing irons 2, 3, 3 contain the vapor supplying device 13.

The above mentioned sheet 34 is designed to regulate the unnecessary move of the cloth on the lower smoothing irons 2, 3, 3 while pressing the cloth during the pressing step, wherein it is formed with a length corresponding to that of the longitudinal direction of the upper smoothing iron 4, being attached in such a way that it bridges the lower part of the pressing surface 4*a*.

The above said regulation is done when the sheet body 34 is in a plane condition as shown in the FIG. 8, presenting the form of an arch along the above mentioned pressing surface 4*a* after the sheet body 34 having been transformed at the time of pressing. For this, on both sides, right and left, of the sheet body 34 there is formed a long rut 34*a* in the latitudinal direction, retaining the sheet body 34 in such a way as to rock from right to left through the said long rut 34*a* and the retaining protrusion 35 with a head of a large diameter.

This type of the sheet body 34 is made of a thin metal plate having plasticity like stainless, for instance, or the plastic sheet material having heat-resistance by coating polyethylene tetrafluoride, for instance, wherein the resilient material 36 with a pulling coil spring, for instance is attached on both right and left ends in such a direction that the sheet body 34 is kept flat.

When the cloth is smoothed and finished with the device as above constructed, the steps must be taken as above specified. This means, while pinching the both of end sides of the cloth, the vapor supplying device 13 is driven to spray the vapor to the cloth from the lower smoothing irons 2, 3, 3. At the same as this spraying or a little after this, the driving machine 25 is driven to move the pinching device 24 away, thus extending the cloth. The very moment the cloth is released after the driving machine 25 has been driven, the upper smoothing iron 4 is lowered, which iron is heated by driving the air-cylinder 11 for moving up and down. Then, by lowering this upper smoothing iron 4, the sheet body 34 touches the upper surface of the cloth as shown in the FIG. 9, which sheet body is attached to the below part of the upper smoothing iron 4 against the cloth which has been extended and processed. If at this stage the cloth is released from the pinching device 24 of the extending machine 23, the regulation by pressure of the sheet body 34 prevents the cloth from turning aside on the lower smoothing irons 2, 3, 3, even in the case that the pressing piece 27 or the receiving piece 26 get stuck in the end of the cloth or even if either of the right or left side of the pieces releases inconveniently.

After the pinching device 24 has released the cloth, it will retire beneath the lower smoothing irons 2, 3, 3, by the movement of the driving machine 25 (pulling air-cylinder 33).

Consequently, after the upper smoothing iron 4 is lowered, the sheet body 34 will be transformed, almost touching the cloth, just beside the pressing surface 4*a* of the upper smoothing iron 4, providing for a smoothing of the cloth to be finished. After pressing for a certain period of time, each part will be back in its original place. When the upper smoothing iron 4 is elevated, the sheet body 34 will be flat again, wherein the sheet body 34 will be pulled by the operation of the resilient material 36, going back to the original form.

Thus, at the end of extending the cloth by the extending machine 23, the sheet body 34 regulates the cloth so that it will not turn aside unnecessarily on the lower smoothing irons 2, 3, 3, while pressing the cloth, thus providing for a sure smoothing of the cloth without shrinkage and like a new one.

Furthermore, the regulating step is done automatically before pressing, going smoothly to the pressing step so that the effect of the operation is secure.

Figure 10:
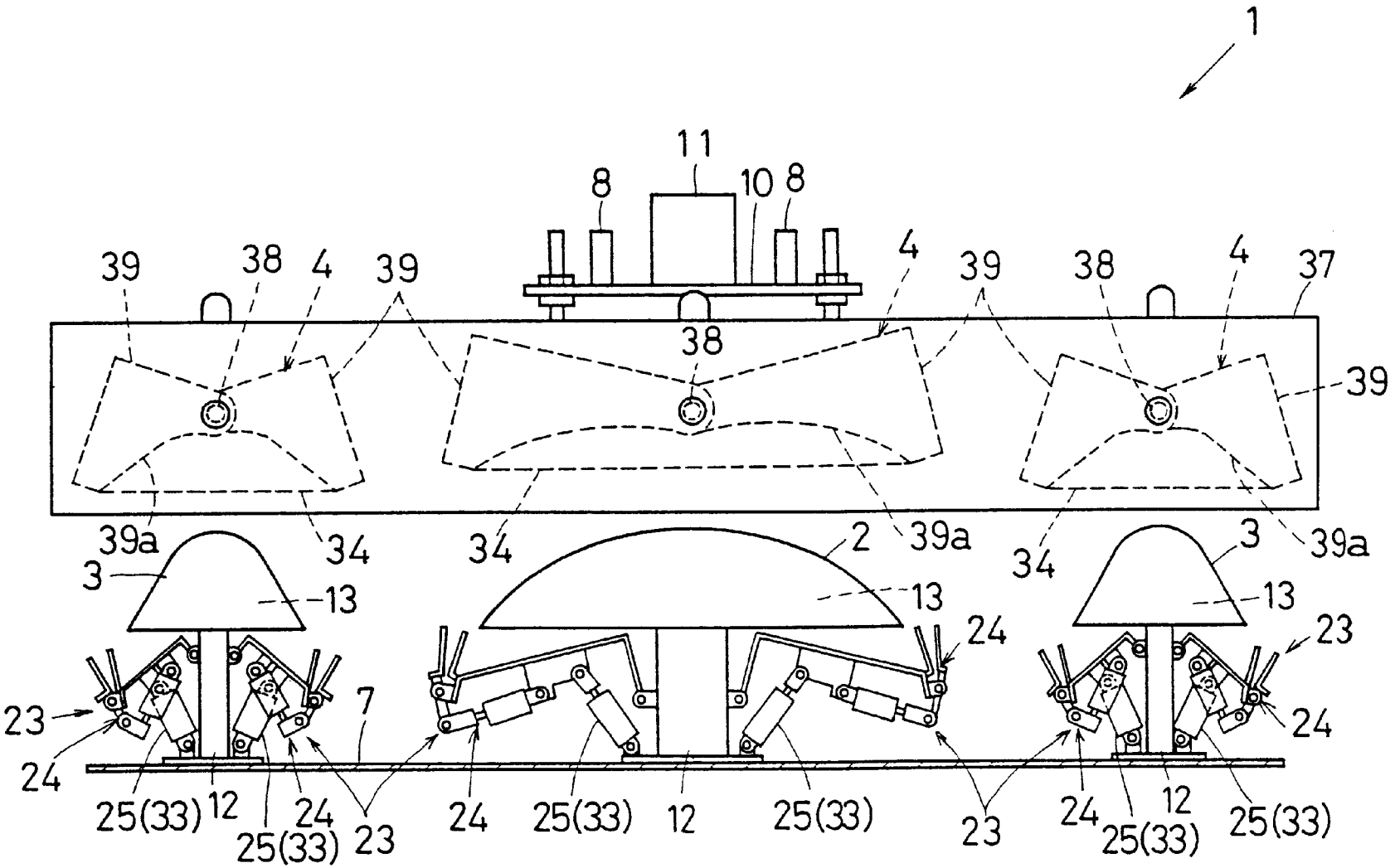
FIG. 10 is a front view of the device for smoothing the cloth to finish according to other examples.
Figure 11:
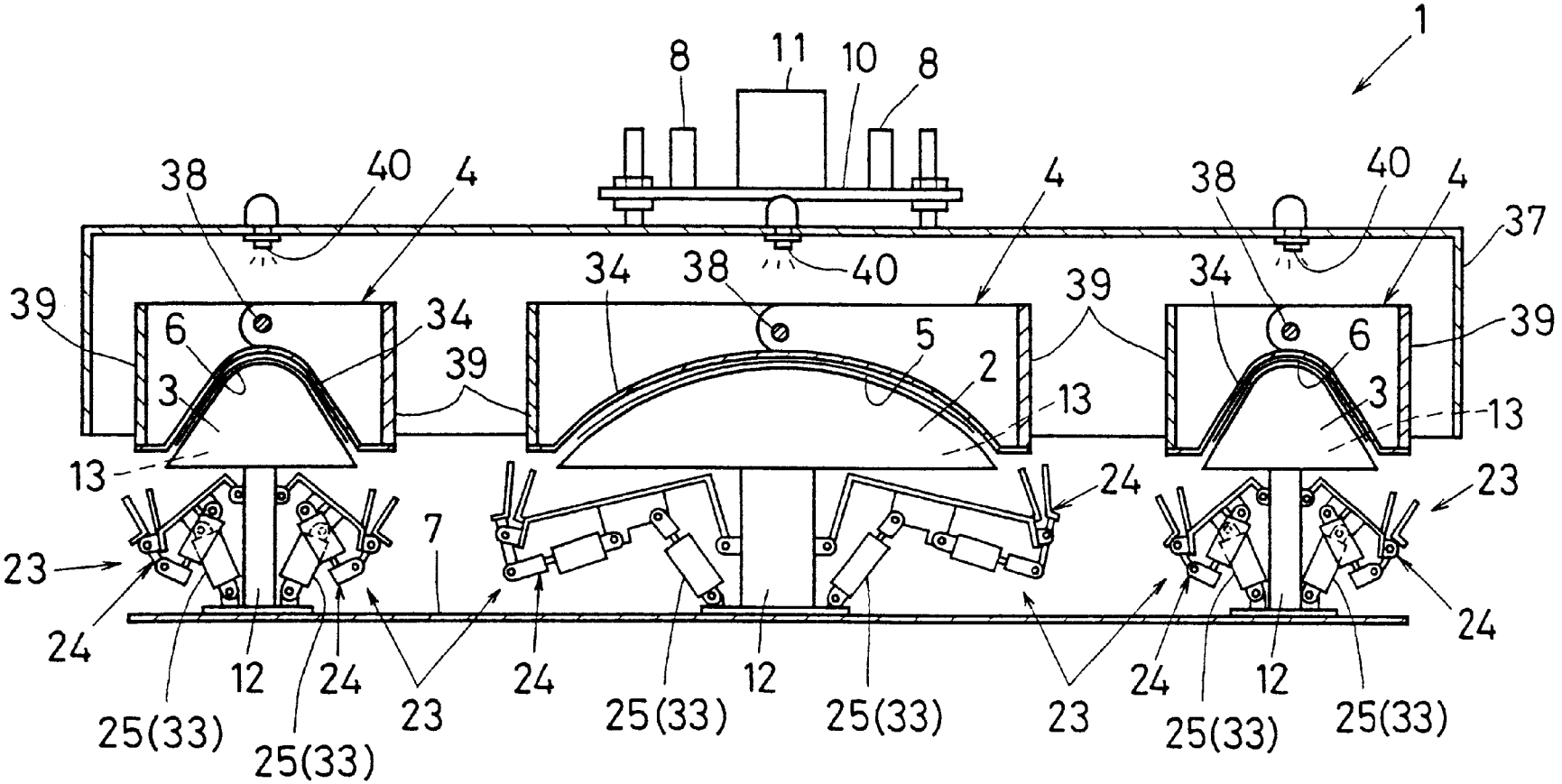
FIG. 11 is a front view of the operation of the device in the FIG. 10.

The device 1 in the FIG. 10 shows an example of the form recording metal being used for the sheet body 34 to regulate the movements of the cloth. Thus, the sheet body 34 is formed as regulating the movements of the cloth, sometimes flat, wherein it takes a determined form necessary for pressing at the pressing step, thus transforming actively according to the temperature with a corresponding form above the lower smoothing irons 2, 3, 3.

In other words, three upper smoothing irons 4 and so on, which have the sheet body 34, are installed together corresponding to the lower smoothing irons 2, 3, 3 and these upper smoothing irons are contained in the supporting body 37 with a form of a rectangular parallelepiped with the below side open. The supporting body 37 goes up and down by the air-cylinder 11, which moves up and down.

The upper smoothing iron 4 for collars and the upper smoothing irons 4, 4 for sleeves are composed of the supporting axle 38 to turn the cloth across backwards and forwards to a determined position inside the above said supporting body 37 and two supporting cases 39, 39, rotating with a certain angle toward up and down around the said supporting axle 38 and of the above said sheet body 34 fixed on the below part of these supporting cases 39, 39. The below surface 39*a* extending from the below part of the above mentioned supporting cases 39, 39 to the upper supporting axle is formed above the surface of the lower smoothing irons 2, 3, 3 in the shape of a corresponding curve, supporting the sheet body 34 as the sheet body 34 is transformed. On the positions corresponding to each of the upper smoothing irons 4 and so on, being found on the upper space of the supporting body 37, there is formed the vapor spraying outlets 40 and so on, for heating the sheet body 34 as shown in the FIG. 11. The sheet body 34 transforms with a high temperature necessary for a pressing step, and is made out in such a way that it recovers the original form when getting cooled without being exposed to vapor.

The lower smoothing irons 2, 3, 3 other than the above mentioned smoothing iron 4 and the extending machine 23 and others are the same as in the first examples and their particular explanation will be omitted.

The device 1 thus constructed, drives the extending machine 23 while spraying vapor from the lower smoothing irons 2, 3, 3, after the cloth is put on the lower smoothing irons 2, 3, 3 to be ready for operation by the extending machine 23. At the same time or a certain time later, the supporting body 37 will be lowered.

By the lowering of this supporting body 37, the sheet body 34 of each of the upper smoothing irons 4 and so on, touch the top surface of the cloth becoming extended, which cloth is pressed. Thus, even when the cloth is fully extended by driving the extending machine 23, which machine 23 turns aside from the cloth, the sheet body 34 regulates unnecessary movements of the cloth by touching directly the cloth. Then, vapor is sprayed to the upper smoothing irons 4 and so on, from the vapor spraying outlets 40 and so on in order to transform the sheet body 34 of the upper smoothing iron 4, thus pressing the cloth (See the FIG. 11.) by lowering furthermore the supporting body 37 (the upper smoothing iron 4). After a certain period of time of spraying vapor and pressing the cloth, each part will be back in its original place.

Figure 12:
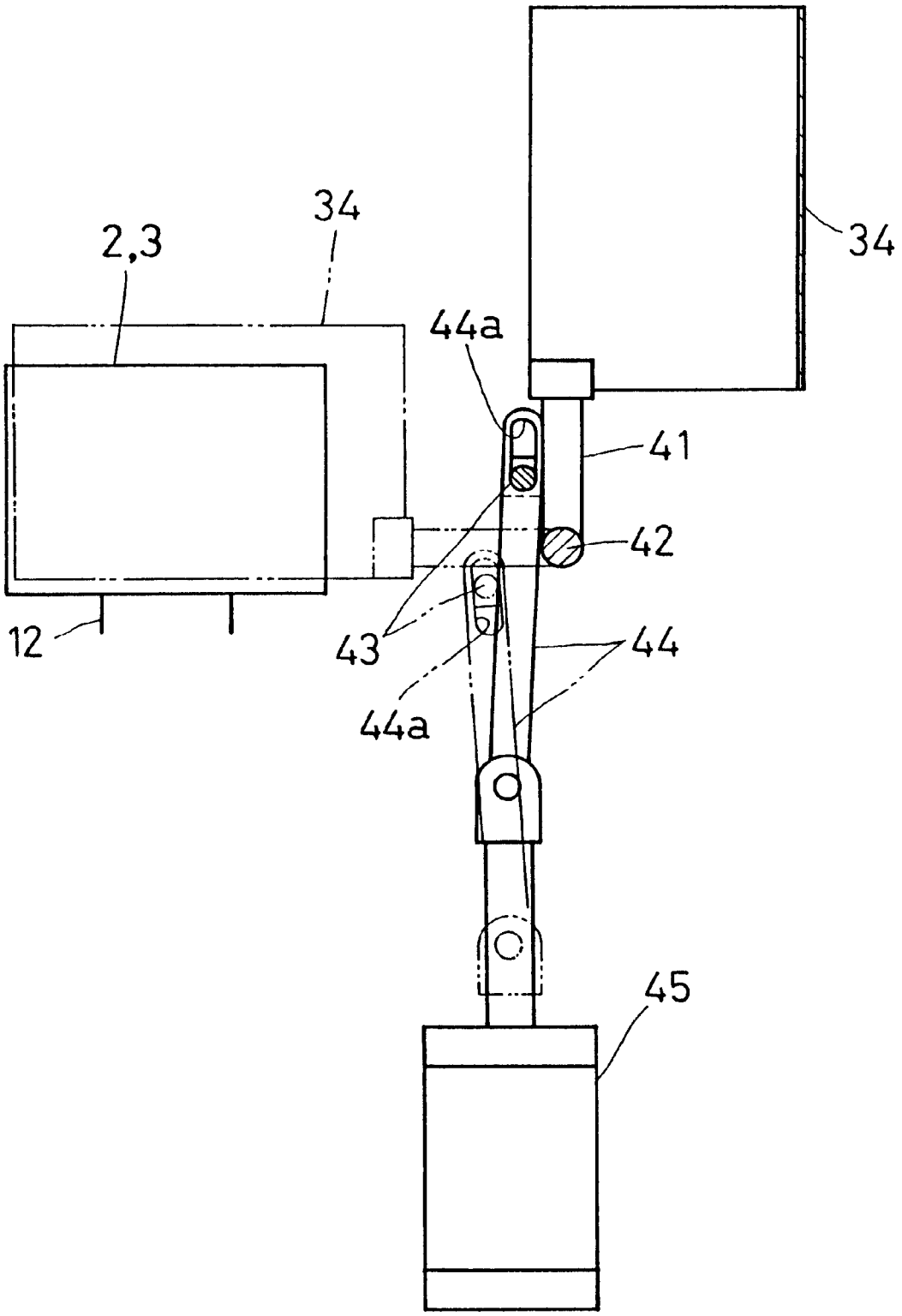
FIG. 12 is a partial side view of the device for smoothing the cloth to finish according to other examples.
Figure 13:
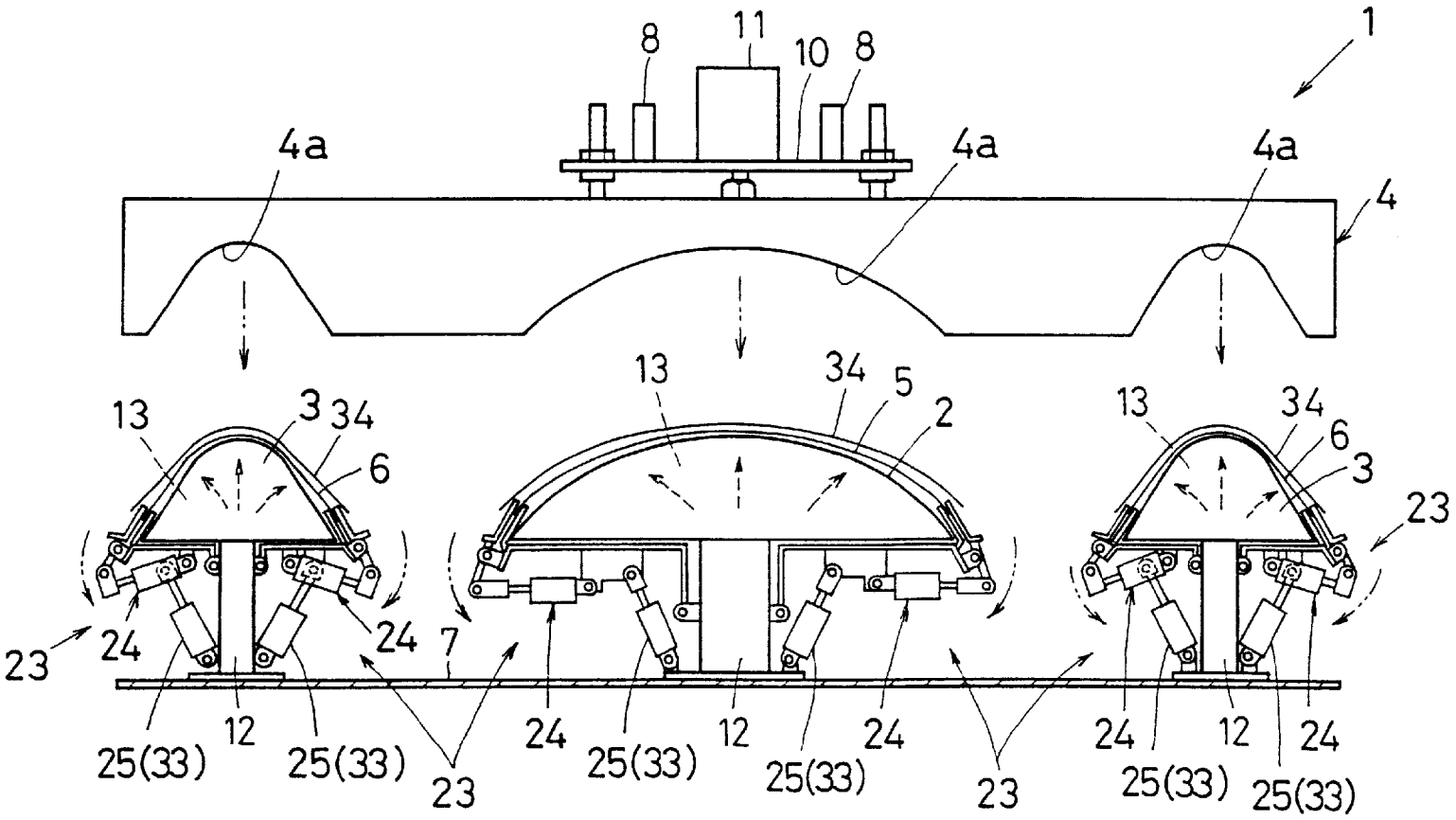
FIG. 13 is a front view of the operation of the device in the FIG. 12.

The FIG. 12 shows the regulating device provided in the vicinity of the lower smoothing irons 2, 2, 3, of the device 1. Besides providing this regulating device, the whole structure is the same as in the primary examples.

The sheet body 34 as the said regulating device is provided in such a way as to rotate and cover the lower smoothing irons 2, 3, 3, from the back side of the lower smoothing irons 2, 3, 3. Concretely, the sheet body 34 is formed of a thin metal plate having plasticity, for example and made with a form and size of an arch, roughly corresponding to the upper surface of the lower smoothing irons 2, 3, 3, supported by the supporting rod 41 on both below ends of its back side as shown in the FIG. 12. The supporting rod 41 with both rear ends, right and left, connected, encases and supports the connecting rod 42 on a determined place on the back side of the lower smoothing irons 2, 3, 3. Furthermore, below the nearby space from the lower smoothing irons, 2, 3, 3 of the above mentioned connecting rod 42 of the supporting rod 41, there is provided the encasing support 43, thus connecting the link 44. On the end of the link 44 and the above said encasing support 43, there is formed the long hole 44*a*, the other end of the link 44 connecting to the air-cylinder 45.

In other words, when the air-cylinder 45 is driven to elevate the link 44, the encasing support 43 will be situated below the long hole 44*a* of the link 44, raising the sheet body 34 vertically. Furthermore, when the link 44 is lowered, the link 44 drags the encasing support 43 to bring down the sheet body 34, thus covering the upper surface of the lower smoothing iron 2, 3, 3 as shown with a virtual line. Then, the axle of the above said encasing support 43 is installed in such a way as to be located roughly in the middle of the long hold 44*a* of the link 44, wherein the sheet body 34 will move downwards when the sheet body 34 is pressed against the lower smoothing irons 2, 3, 3 by the lowering of the upper smoothing iron 4.

According to the device 1 thus constructed, the sheet body 34 will be kept upright as shown with a solid line in the FIG. 12 and with this position the cloth will be put on the lower smoothing irons 2, 3, 3, thus setting the cloth for the extending machine 23. Afterwards, the sheet body 34 will be brought down as shown in the FIG. 16 in order to cover the upper surface of the cloth or the lower smoothing irons 2, 3, 3. After this, vapor will be sprayed from the lower smoothing irons 2, 3, 3, thus driving the extending machine 23. Vapor sprayed from the lower smoothing irons 2, 3, 3, will heat the cloth enough while keeping it moist, without escaping upwards because of the presence of the sheet body 34, thus steaming the cloth. When the cloth is fully extended by the spraying of vapor and the driving of the extending machine 23 for a certain period of time, the upper smoothing iron 4, which is heated, will be lowered. When the extending machine 23 is removed from the cloth, the sheet body 34 prevents the cloth from turning aside by softly covering it with its own weight so that the cloth will be pressed by the lowering of the upper smoothing iron 4 while staying unmoved. After pressing for a certain period of time, each part will be back in its original place.

What is claimed is:

1. A device for smoothing a cloth to be finished, said device comprising:

an upper smoothing iron;

a lower smoothing iron used in combination with said upper smoothing iron to pinch and press said cloth;

an extending machine provided in vicinity of said lower smoothing iron to pull said cloth by pinching said cloth before said pressing of said cloth by said upper and lower irons; and vapor supplying device disposed in vicinity of said lower smoothing iron for spraying vapor onto said cloth; wherein said cloth comprises a shirt having a collar and/or sleeves; and wherein said collar and sleeves are smoothed and finished with said lower and upper smoothing irons by pinching said collar and/or sleeves.

2. The device of claim 1, further comprising:

a regulating device disposed in vicinity of said upper smoothing iron or said lower smoothing iron for regulating movement of said cloth during or immediately before end of said extending by said extending machine.

3. The device of claim 2, wherein said regulating device is disposed below said upper smoothing iron and comprises a sheet body which is flat at time of regulating movement of said cloth and is transformed according to shape needed for pressing.

4. The device of claim 2, wherein said regulating device is disposed in vicinity of said lower smoothing iron together with a sheet body covering said lower smoothing iron.

5. A method of smoothing a collar and/or sleeves of a shirt to be finished, comprising the steps of pressing said collar and/or sleeves while lowering an upper smoothing iron against said collar and/or sleeves disposed on a lower smoothing iron;

applying a force to said collar and/or sleeves during or prior to said pressing step thereby to extend said collar and/or sleeves; and spraying said collar and/or sleeves with vapor during said extending of said collar and/or sleeves.

6. The method of claim 5, comprising the further step of regulating movement of said collar and/or sleeves while applying force thereto.

7. The method of claim 6, wherein said regulating is done with a device located in vicinity of said upper smoothing iron together with a flat sheet body which is disposed on said collar and/or sleeves.

8. The method of claim 6, wherein said regulating is done with a device located in vicinity of said lower smoothing iron together with a sheet body wich is disposed on said collar and/or sleeves.

* * * * *